US006057655A

United States Patent [19]

Jongen

[11] Patent Number: 6,057,655

[45] Date of Patent: May 2, 2000

[54] METHOD FOR SWEEPING CHARGED PARTICLES OUT OF AN ISOCHRONOUS CYCLOTRON, AND DEVICE THEREFOR

[75] Inventor: Yves Jongen, Louvain-la-Neuve, Belgium

[73] Assignee: Ion Beam Applications, S.A., Louvain-la-Neuve, Belgium

[21] Appl. No.: 09/051,306

[22] PCT Filed: Sep. 25, 1996

[86] PCT No.: PCT/BE96/00101

§ 371 Date: Apr. 3, 1998

§ 102(e) Date: Apr. 3, 1998

[87] PCT Pub. No.: WO97/14279

PCT Pub. Date: Apr. 17, 1997

[30] Foreign Application Priority Data

Oct. 6, 1995 [BE] Belgium ..... 09500832

[51] Int. Cl.[7] ..... H05H 13/00

[52] U.S. Cl. ..... 315/502; 315/507; 313/62; 313/359.1

[58] Field of Search ..... 315/502, 504; 313/62, 359.1

[56] References Cited

U.S. PATENT DOCUMENTS

| | | | |
|---|---|---|---|
| 3,024,379 | 3/1962 | Verster | 313/62 |
| 3,175,131 | 3/1965 | Burleigh et al. | 317/158 |
| 4,771,208 | 9/1988 | Jongen et al. | 313/62 |
| 5,463,291 | 10/1995 | Carroll et al. | 315/502 |
| 5,521,469 | 5/1996 | Laisne | 315/502 |

FOREIGN PATENT DOCUMENTS

| | | | |
|---|---|---|---|
| 2.139.671 | 1/1973 | France | H05H 13/00 |
| WO 93/10651 A1 | 5/1993 | WIPO | H05H 13/00 |

OTHER PUBLICATIONS

Wolber, Gerd et al, "A Kicker Magnet for Sweeping Ion Beams from a Medical Cyclotron", Nuclear Instr. and Methods in Physics Research A256 (1987) 434–438.

*Primary Examiner*—Edward P. Westin
*Assistant Examiner*—Nikita Wells
*Attorney, Agent, or Firm*—Alix, Yale & Ristas, LLP

[57] ABSTRACT

A method for extracting a charged particle beam out of an isochronous cyclotron (1) comprising an electromagnet forming a magnetic circuit that includes at least a number of sectors (3, 3') known as "hills" where the air-gap is reduced, and separated by sector-shaped spaces (4) known as "valleys" where the air-gap is larger. According to the extraction method, the particle beam is extracted without using an extraction device as the magnetic field has a special arrangement produced by designing the electromagnet air-gap at the "hills" (3, 3') of the isochronous cyclotron in such a way that the aspect ratio between the electromagnet air-gap at the "hills" in the region of the maximum radius, and the radius gain per turn of the particles accelerated by the cyclotron at said radius is less than 20.

6 Claims, 3 Drawing Sheets

METHOD FOR SWEEPING CHARGED PARTICLES OUT OF AN ISOCHRONOUS CYCLOTRON, AND DEVICE THEREFOR

CROSS-REFERENCE TO RELATED APPLICATIONS

This is the national stage of International Application No. PCT/BE96/00101 filed Sep. 25, 1996.

SUBJECT OF THE INVENTION

The present invention relates to a method of extracting charged particles from an isochronous cyclotron in which the particle beam is focused by sectors.

The present invention also relates to the said isochronous cyclotron which applies this method of extracting charged particles.

The present invention relates both to compact isochronous cyclotrons and to cyclotrons focused by sectors. Similarly, the present invention relates to isochronous cyclotrons referred to as superconducting or non-superconducting.

Prior art

Cyclotrons are particle accelerators used, in particular, for the production of radioactive isotopes. These cyclotrons are usually composed of two distinct main assemblies, consisting on the one hand of the electromagnet and on the other hand of the radiofrequency resonator.

The electromagnet guides the charged particles on a path approximately representing a spiral whose radius increases around the acceleration. In modern cyclotrons of the isochronous type, the electromagnet poles are divided into sectors which alternately have a reduced air gap and a larger air gap. The azimuthal variation in the magnetic field which results therefrom has the effect of focusing the beam vertically and horizontally during the acceleration.

Among isochronous cyclotrons, distinction should be made between cyclotrons of the compact type, which are excited by at least one main circular coil, and cyclotrons referred to as having separate sectors, in which the magnetic structure is divided into fully self-contained separate units.

The second assembly consists of the accelerating electrodes, frequently referred to as "dees" for historical reasons. An alternating voltage of several tens of kilovolts is thus applied to the electrodes at the frequency of rotation of the particles in the magnet, or alternately at a frequency which is an exact multiple of the frequency of rotation of the particles in the magnet. This has the effect of accelerating the particles of the beam circuiting in the cyclotron.

For a number of applications which use a cyclotron, it is necessary to extract the beam of accelerated particles from the cyclotron and guide it to a target where it is intended to be used. This beam extraction operation is considered by the person skilled in the art to be the most difficult step in the production of a beam of accelerated particles using a cyclotron. This operation consists in bringing the beam from the part of the magnetic field where it is accelerated to the point where the magnetic field is no longer capable of holding the beam. In this case, the beam is free to escape from the influence of the field and is extracted from the cyclotron.

In the case of cyclotrons which accelerate positively charged particles, it is known to use an electrostatic deflector, the purpose of which is to pull the particles out of the magnetic field in the manner of an extraction device. In order to obtain an effect of this type, it is necessary for an electrode, which is referred to as the septum and will intersect a fraction of the particles, to be interposed on the path of these particles. For this reason, the extraction efficiency is relatively limited, and the loss of particles in the septum will contribute, in particular, to making the cyclotron highly radioactive.

It is also known to extract negatively charged particles by converting the negative ions into positive ions by passing them through a sheet whose function is to strip the electrons from the negative ions. This technique makes it possible to obtain extraction efficiencies close to 100% and also makes it possible to use a device which is must less complex than the one described above. Nevertheless, for its part, the acceleration of the negative particles presents major difficulties. The main drawback resides in the fact that the negative ions are fragile, and are therefore readily dissociated by residual gas molecules or excessive magnetic fields which are present in the cyclotron and through which the ions pass at high energy. The transmission of the beam in the accelerator is therefore limited, which also contributes to its activation.

On the other hand, cyclotrons which accelerate positive particles make it possible to produce greater beam currents and make the system more reliable, while permitting a significant reduction in the size and weight of the machine.

A technique is also known, from The Review of Scientist Instruments, 27 (1956), No. 7 and from Nuclear Instruments and Methods 18, 19 (1962), pp. 41–45 by J. Reginald Richardson, according to which method it would have been possible to extract the particle beam from the cyclotron without using an extraction device. The conditions required to obtain this auto-extraction are particular conditions relating to resonance of the motion of the particles in the magnetic field.

Nevertheless, this described method is particularly difficult to implement, and would have given a beam whose optical qualities were so poor that it has never been applied in practice.

U.S. Pat. No. 0,324,379 relates to a device of the cyclotron type which is intended to accelerate particles and has magnetic means that are essentially independent of the azimuthal angle. This means that the cyclotron is a non-isochronous one. It should furthermore be noted that the cyclotron which is described has beam extraction means which consist of "regenerators" and "compressors" which, by perturbing the magnetic field, make it possible to extract the particle beam.

WO-93/10651 in the name of the Applicant Company describes a compact isochronous cyclotron having an air gap located between two hills, of essentially elliptical shape and tending to close on itself completely at the radial end of the hills on the median plane. The device described in this document also comprises conventional beam extraction means which, in the present case, consist of an electrostatic deflector.

OBJECTS OF THE PRESENT INVENTION

One object of the present invention is to provide a method of extracting charged particles from an isochronous cyclotron while avoiding the use of extraction devices such as the ones described above.

An additional object of the present invention is therefore to provide an isochronous cyclotron which is of simpler and more economical design than those used conventionally.

A further object of the invention is to increase the particle beam extraction efficiency, in particular in the case of extracting positive particles.

MAIN CHARACTERISTIC ELEMENTS OF THE PRESENT INVENTION

The present invention relates to a method of extracting charged particles from an isochronous cyclotron having an electromagnet constituting the magnetic circuit which includes a certain number of pairs of sectors, referred to as "hills", where the air gap is reduced, these being separated by spaces in the form of sectors, referred to as "valleys", where the air gap is of larger size; this method being characterized in that an isochronous cyclotron is produced with a magnet air gap between the hills whose dimensions are chosen in such a way that the minimum value of this air gap in the vicinity of the maximum radius between the hills is less than twenty times the gain in radius per circuit of the particles accelerated by the cyclotron at this radius.

According to this particular configuration, it will be observed that the ions can be extracted from the influence of the magnetic field without the assistance of any extraction device.

It should be noted that, in the case of prior art isochronous cyclotrons, the air gap of the magnet is in general between 5 and 20 cm, while the gain in radius per circuit is about 1 mm. In this case, the ratio of the air gap to the gain in radius per circuit is greater than 50.

It will be observed that, when the main characteristic of the present invention is applied, the magnetic field decreases very abruptly in the vicinity of the limit of the pole of the magnet, so that the auto-extraction point is reached before the phase shift of the particles with respect to the accelerating voltage reaches 90 degrees. In this way, the particles leave the magnetic field automatically without the intervention of any extraction device.

According to a particularly preferred embodiment of the present invention, it may be envisaged to design an air gap having an elliptical profile which tends to close on itself at the radial end of the hills, as described in Patent WO93/10651.

According to a preferred embodiment of the present invention, the extraction of the particles is concentrated on one sector by virtue of an asymmetry given deliberately to the shape or to the magnetic field of the said sector.

According to another preferred embodiment of the present invention, the angle of one of the sectors is reduced at the pole radius in order to make it possible to shift the orbits and thus to obtain the extraction of the entire beam on this side so as, for example, to make it possible to irradiate a target of large volume.

According to another preferred embodiment of the present invention, a particular distribution of the particle beam is produced so as simultaneously to irradiate a plurality of targets mounted side by side on the path of the beam.

The present invention can advantageously be used for proton therapy or the production of radioisotopes, and more particularly radioisotopes intended for positron emission tomography (PET).

DESCRIPTION OF A PREFERRED EMBODIMENT OF THE INVENTION

The profile of the magnetic field in an isochronous cyclotron is such that the frequency of rotation of the particles should be constant and independent of their energy. In order to compensate for the increase in the relativistic mass of the particles, the magnetic field should therefore increase with the radius in order to ensure this isochronism condition. To describe this relationship, the field index is defined by the following equation:

$$n = \frac{dB}{B} \cdot \frac{R}{dR}$$

in which dB/B and dR/R are respectively the relative variations in the magnetic field and in the radius at radius R.

It should be noted that it is impossible to maintain the isochronism condition in the vicinity of the maximum radius of the pole. The reason for this is that, at this moment, the field ceases to increase with the radius. It has reached a maximum and then starts to decrease more and more rapidly.

Figure 1:
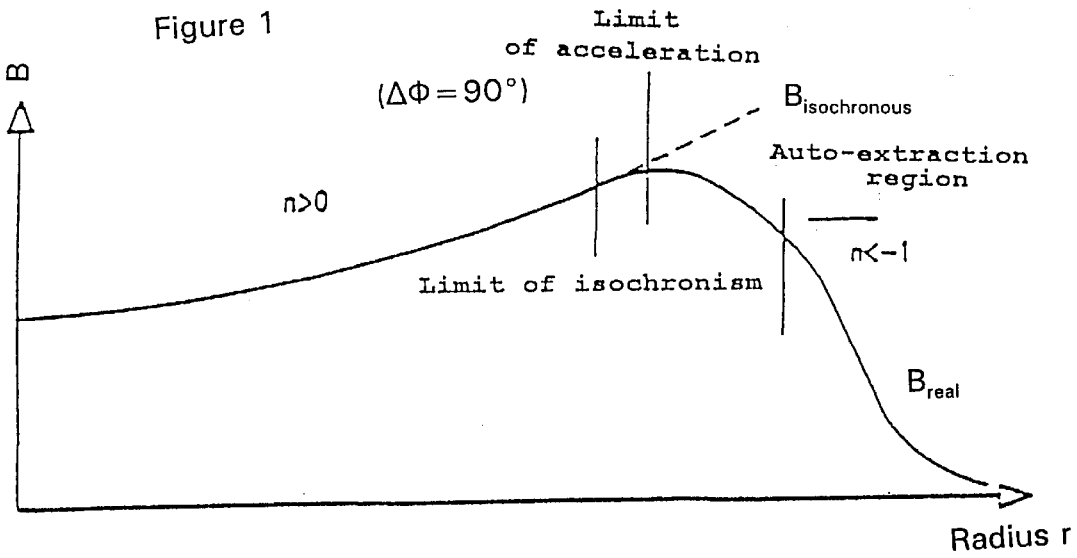
FIGS. 1 and 2 represent magnetic profiles of a prior art isochronous cyclotron and of an isochronous cyclotron using the extraction method according to the present invention.

FIG. 1 illustrates the variation in the field as a function of the radius in a conventional isochronous cyclotron. An increasing phase shift is set up between the frequency of rotation of the particles and the resonant frequency of the accelerating electrodes. When this phase shift reaches 90 degrees, the particles cease to be accelerated and cannot exceed this radius.

Figure 2:
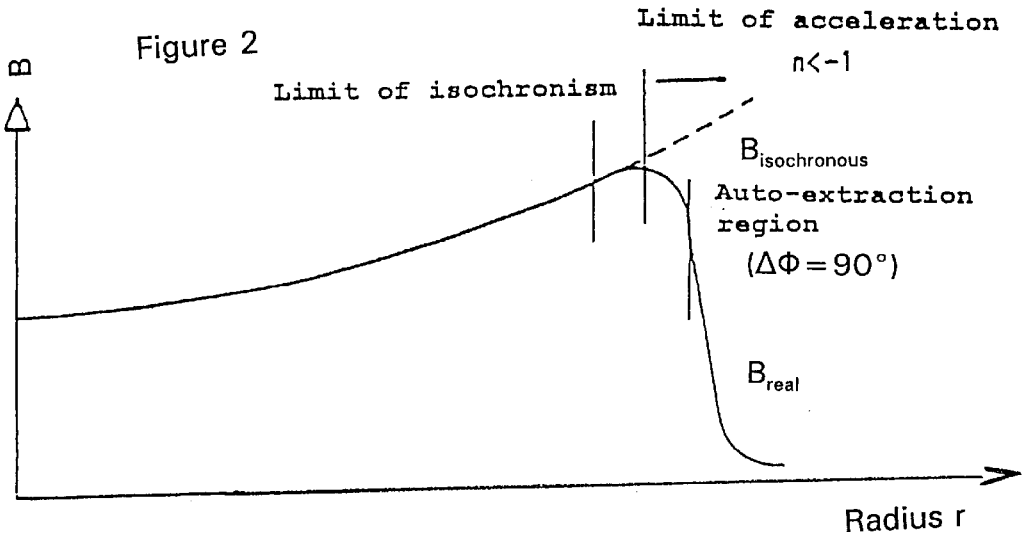

FIG. 2 illustrates the variation in the field as a function of the radius in an isochronous cyclotron using the extraction method according to the present invention. By accurately choosing the dimensions of the air gap of the magnet between the hills in such a way that it is reduced to a value of less than twenty times the gain in radius per circuit, a magnetic field profile as represented in FIG. 2 is observed.

In this case, the magnetic field decreases very abruptly in the vicinity of the limit of the pole of the magnet, so that the auto-extraction point defined by the field index n=−1 is reached before the phase shift of the particles with respect to the accelerating voltage reaches 90 degrees.

From this moment on, the particles automatically leave the magnetic field without the intervention of any extractor device.

Figure 3:
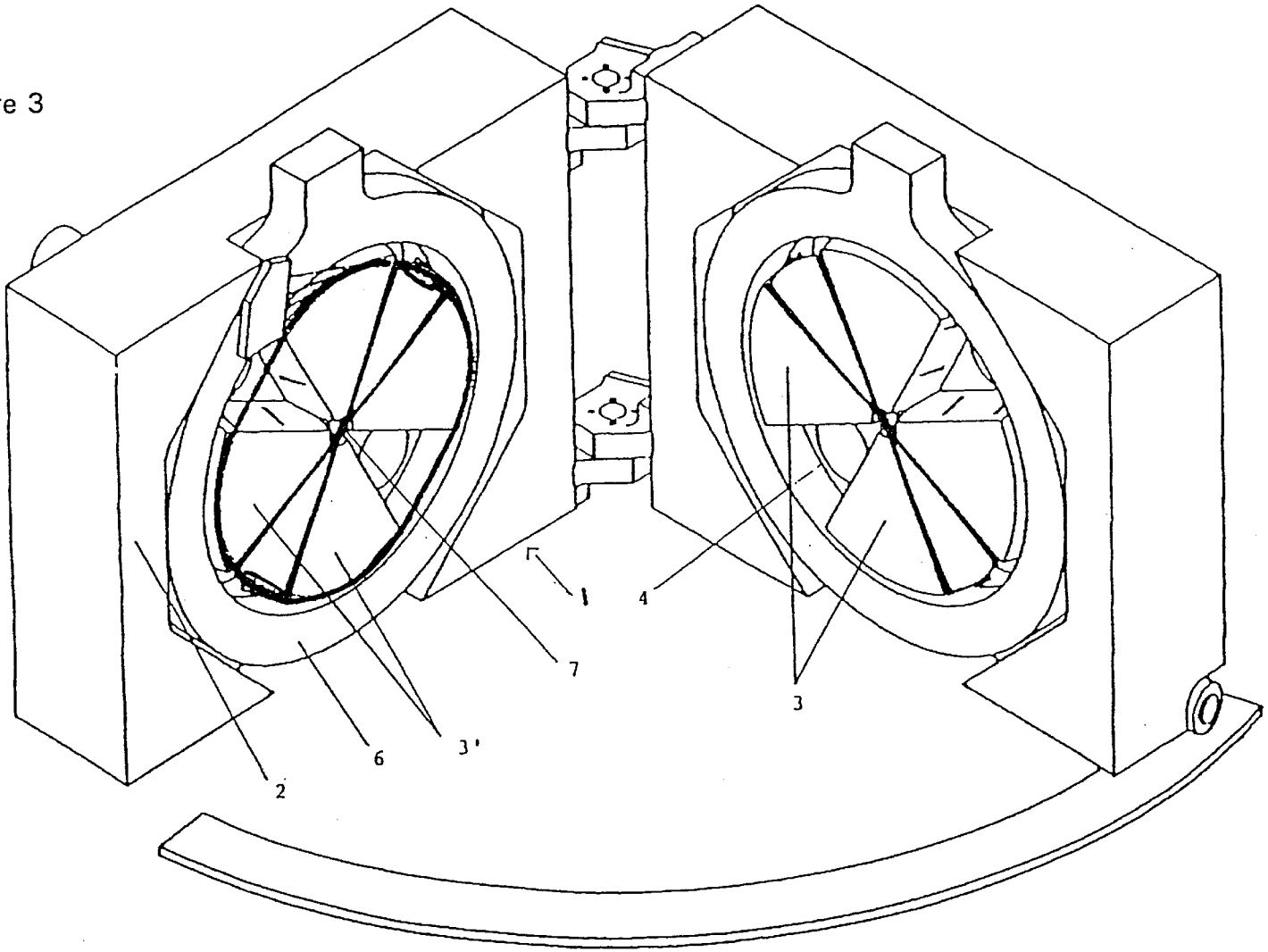
FIG. 3 schematically represents an exploded view of the main elements constituting an isochronous cyclotron.
Figure 4:
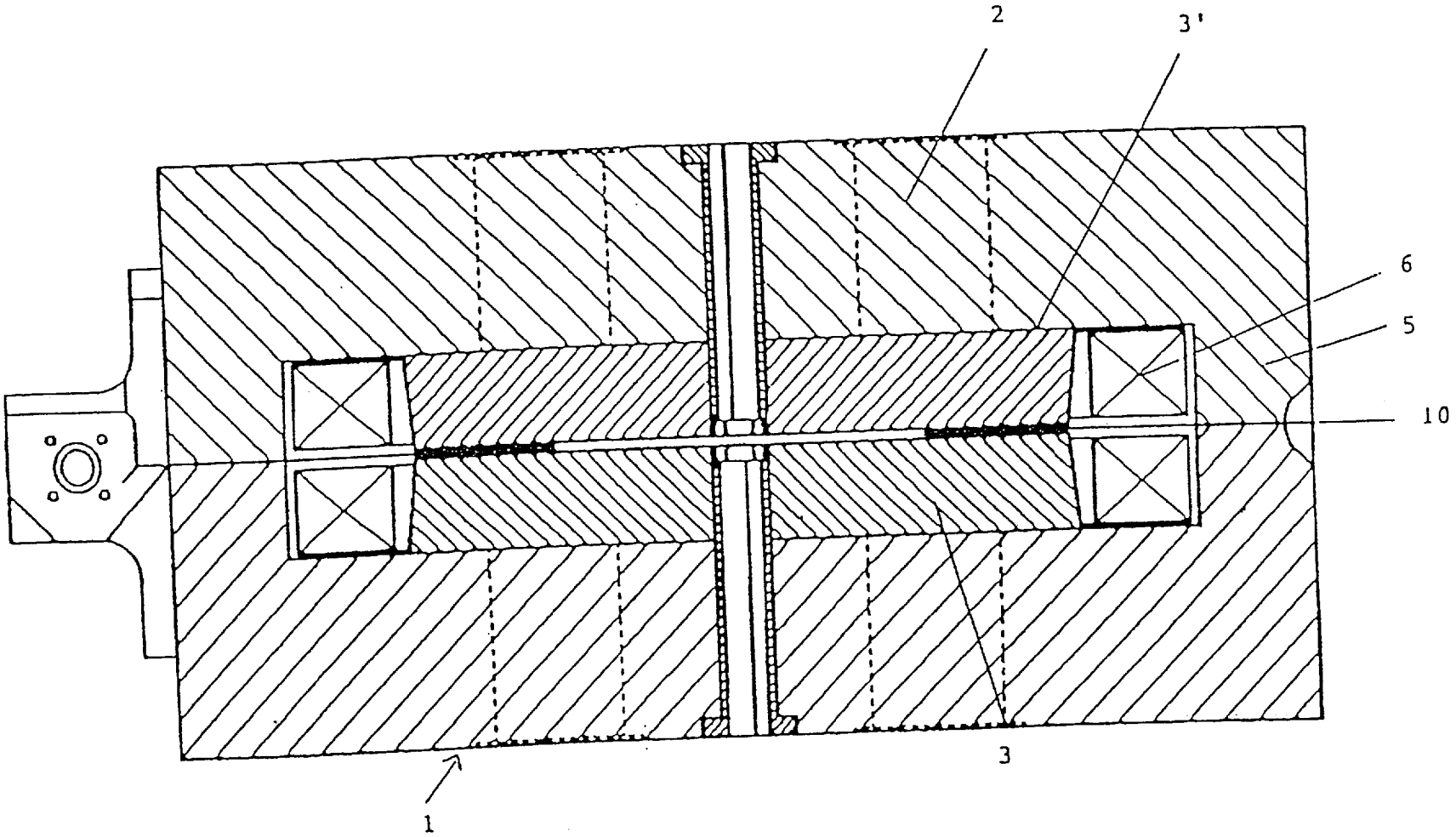
FIG. 4 represents a cross-section of an isochronous cyclotron.

An isochronous cyclotron as used in the method of extracting charged particles according to the present invention is represented schematically in FIGS. 3 and 4. This cyclotron is a compact isochronous cyclotron intended for the acceleration of positive particles, and more particularly protons.

The magnetic structure 1 of the cyclotron is composed of a certain number of elements 2, 3, 4 and 5 made of a ferromagnetic material and coils 6 preferably made of a conductive or superconductive material. In conventional fashion, the ferromagnetic structure comprises:

two base plates 2 and 2', referred to as yokes, at least three upper sectors 3, referred to as hills, and an equal number of lower sectors 3', which are located symmetrically relative to a plane of symmetry 10, referred to as the median plane, with respect to the upper sectors 3, and which are separated by a small air gap 8, between two successive hills there is a space where the dimension of the air gap is greater, and this is referred to as a valley 4, at least one flux return 5 rigidly joining the lower yoke 2 to the upper yoke 2'.

The coils 6 are of essentially circular shape and are located in the annular space left between the sectors 3 or 3' and the flux returns 5.

The central channel is intended to accommodate at least a part of the source of particles 7 to be accelerated. These particles are injected at the centre of the apparatus by means which are known per se.

For an isochronous cyclotron accelerating a proton beam to an energy of 11 MeV, the magnet is designed, according to the invention, with an air gap of 10 mm for a magnetic field of 2 teslas on the magnetic sectors 3 and 3'. The accelerating voltage is 80 kilovolts, so as to obtain a gain in radius of 1.5 mm at the maximum radius.

This unusual choice of parameters makes it possible, at the radial extremity of the hills, to observe an extremely rapid decrease in the external induction, which makes it possible to auto-extract the particle beam before the acceleration limit, and this is more particularly represented in FIG. 2.

According to a first preferred embodiment, the angle of one of the sectors is reduced at the pole radius so as to make it possible to shift the orbits and obtain extraction of the entire beam on this side (see FIG. 4).

The extracted particle beam is then axially focused and radially defocused.

According to another preferred embodiment, this beam profile is used for the simultaneous irradiation of four targets located between the two coils 6 mounted side by side on the path of the beam.

I claim:

1. Method of extracting a beam of charged particles from an isochronous cyclotron (1) having an electromagnet constituting the magnetic circuit which includes at least a certain number of sectors (3, 3'), referred to as "hills", where the air gap is reduced, these being separated by spaces in the form of sectors (4), referred to as "valleys", where the air gap is of larger size, the extraction method being characterized in that the particle beam is extracted by a particular arrangement of the magnetic field, without resorting to an extraction device, this arrangement being obtained by designing the air gap of the magnet at the hills (3, 3') of the isochronous cyclotron in such a way that the ratio of the dimension of the air gap of the magnet at the hills in the vicinity of-the maximum radius to the gain in radius per circuit of the particles accelerated by the cyclotron at this radius is less than 20.

2. Isochronous cyclotron in which the particle beam is focused by sectors and which has an electromagnet constituting the magnetic circuit which includes at least a certain number of sectors (3, 3'), referred to as "hills", where the air gap is reduced, these being separated by spaces in the form of sectors (4), referred to as "valleys", where the air gap is of larger size, characterized in that the air gap of the magnet at the hills (3, 3') is designed in such a way that the ratio of the dimension of the air gap of the magnet at the hills in the vicinity of the maximum radius to the gain in radius per circuit of the particles accelerated by the cyclotron at this radius is less than 20.

3. Isochronous cyclotron according to claim 2, characterized in that the profile of the air gap of the magnet at the hills is an elliptical profile tending to close on itself at the radial end of the hills.

4. Cyclotron according to claim 2, characterized in that at least one sector has a shape or a magnetic field that is asymmetric with respect to the other sectors.

5. Cyclotron according claim 2, characterized in that the angle of one of the sectors is reduced at the pole radius.

6. Cyclotron according to claim 2, characterized in that a particular distribution of the particle beam is produced so as simultaneously to irradiate a plurality of targets mounted side by side on the path of the beam.

* * * * *